US005991960A

United States Patent [19]

Johnson

[11] Patent Number: 5,991,960

[45] Date of Patent: Nov. 30, 1999

[54] DEVICE FOR CLEANING OPTICAL SURFACES

[75] Inventor: Anthony L. Johnson, Rochester, N.Y.

[73] Assignee: Eastman Kodak Company, Rochester, N.Y.

[21] Appl. No.: 08/908,848

[22] Filed: Aug. 8, 1997

[51] Int. Cl.[6] ..... A47K 7/02; A61F 13/38

[52] U.S. Cl. ..... 15/210.1; 15/209.1; 15/104.165; 300/210; 604/1; 19/145.3

[58] Field of Search ..... 15/210.1, 209.1, 15/211, 104.165; 19/145, 145.3; 604/1; 300/21

[56] References Cited

U.S. PATENT DOCUMENTS

| | | | |
|---|---|---|---|
| 131,855 | 10/1872 | Crandal | 15/247 |
| 2,288,592 | 7/1942 | Mirhige | 15/247 |
| 2,346,782 | 4/1944 | Piluso | 300/21 |
| 3,462,790 | 8/1969 | Lingle | 15/247 |
| 3,591,885 | 7/1971 | Fritzen | 15/210.1 |
| 4,259,955 | 4/1981 | Ritter | 128/269 |
| 5,214,821 | 6/1993 | Burrow et al. | 15/210.1 |
| 5,239,723 | 8/1993 | Chen | 15/104.002 |
| 5,346,287 | 9/1994 | Burrow et al. | 300/21 |
| 5,363,532 | 11/1994 | Sargent | 15/268 |
| 5,709,006 | 1/1998 | Carter, Jr. | 15/247 |
| 5,736,469 | 4/1998 | Bhattacharjee et al. | 15/209.1 X |

*Primary Examiner*—Elizabeth McKane
*Attorney, Agent, or Firm*—David M. Woods

[57] ABSTRACT

A clean wipe device for cleaning an optical surface, like the cover glass on a charge coupled device (CCD) imager surface, and the method to make the same, comprises an elongated support, an absorbent swab attached to an end of the elongated support, and a cleaning element. The cleaning element is secured to the end of the support so as to cover the swab and to present an elongated side as a broad cleaning surface. In addition, the elongated side extends between two acute angle end sections of the cleaning element, thus presenting two corner cleaning surfaces to the optical surface.

14 Claims, 3 Drawing Sheets

DEVICE FOR CLEANING OPTICAL SURFACES

FIELD OF THE INVENTION

The invention relates generally to a device and method of making a device for cleaning optical surfaces, and in particular to a device which clean wipes an optical surface.

BACKGROUND OF THE INVENTION

Optical surfaces, like optically coated glass on charge coupled device (CCD) imager surfaces which are located inside the body of a camera, require periodic cleaning. These surfaces are often placed in areas which are difficult to reach. In particular, the human finger with a piece of cloth attached is sometimes unable to reach these critical optical surfaces. Typical cleaning devices are unable to adequately reach all portions of the optical surfaces requiring cleaning and provide thorough cleaning of them.

It is well known to use a knit fabric swab as a cleaning device for cleaning optical surfaces. These cleaning devices are made by attaching the knit fabric swab atop an elongated support. These types of swabs are shown in U.S.

Pat. No. 5,239,723 entitled Gelatinous Elastomer Swabs, U.S. Pat. No. 5,214,821 entitled Low Contamination Swab Employing Tubular Knit Fabric, and U.S. Pat. No. 4,259,955 entitled Applicator Swab and Method of Making the Same. It is also known to have an applicator mounted atop an elongated support for applying substances, e.g. polishes to an object. See for example U.S. Pat. No. 2,346,782 entitled Methods of Manufacturing Applicators or Daubers. It would be useful to have a cleaning device which is able to clean difficult to reach surfaces and to clean the surfaces thoroughly.

SUMMARY OF THE INVENTION

The present invention is directed to overcoming one or more of the problems set forth above. Briefly summarized, the present invention is to provide a device which can clean difficult to reach optical surfaces and clean these surfaces thoroughly.

This object is achieved by having a clean wipe device comprising:

an elongated support;

an absorbent swab attached to an end of the support; and a cleaning element secured to the end of the support so as to cover the swab and to present an elongated side as a broad cleaning surface, the elongated side extending between two acute angle end sections of the cleaning element which present two corner cleaning surfaces.

An advantage of the present invention is that the cleaning element is folded to present a broad cleaning surface.

Another advantage of the present invention is to provide two angled cleaning surfaces in addition to the broad cleaning surface. These two angled cleaning surfaces are formed from the corner end sections of the folded cleaning element. These end sections provide pointed surfaces that are easy to get into difficult to clean locations.

These and other aspects, objects, features and advantages of the present invention will be more clearly understood and appreciated from a review of the following detailed description of the preferred embodiments and appended claims, and by reference to the accompanying drawings.

DETAILED DESCRIPTION OF THE INVENTION

Figure 1:
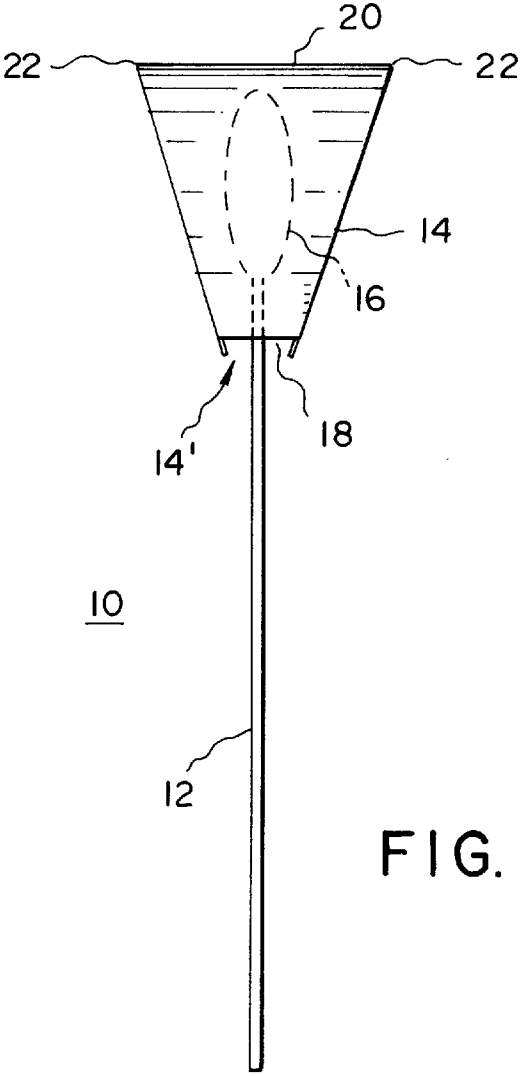
FIG. 1 is a front view of the cleaning device.
Figure 4:
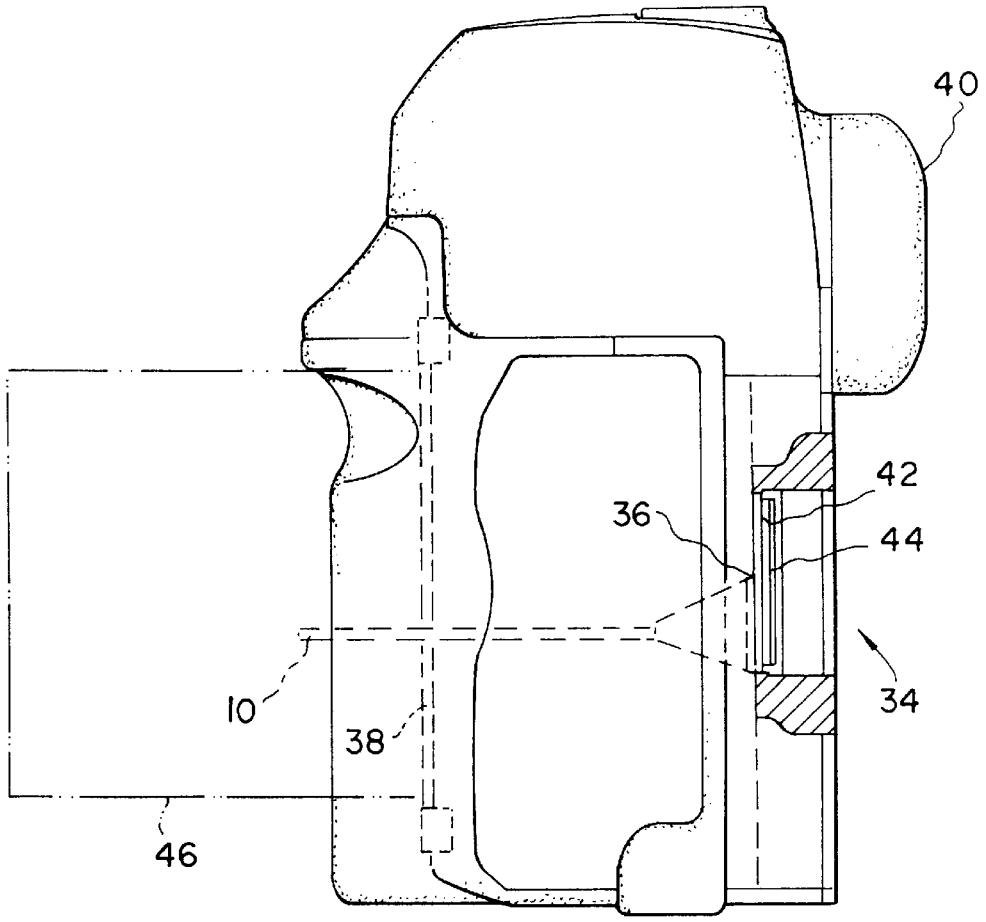
FIG. 4 is a perspective of a camera unit showing the location of a cover glass of a CCD imager surface.

Beginning with FIG. 1, the cleaning device 10 for cleaning optical surfaces, such as a cover glass of a charge coupled device (CCD) imager surface shown in FIG. 4, comprises an elongated support 12, an absorbent swab 16 attached to an end of the support 12 and a cleaning element 14. The swab 16 is made of a dry, polyurethane foam. The cleaning element 14 is secured to the same end of the support as the swab 16. The cleaning element is made of a non-woven, polyester and cellulose blended material such as a Durx 670™ cleaning cloth available from Berkshire Corporation, Great Barrington, Mass. The cleaning element 14 is secured to the elongated support 12 by a clean rubber band 18 that causes the cleaning element 14 to taper into a triangular, or paddle shape. The elongated support 12, the cleaning element 14, the swab 16, and the clean rubber band satisfy a clean standard for electronic manufacturing.

Figure 2:
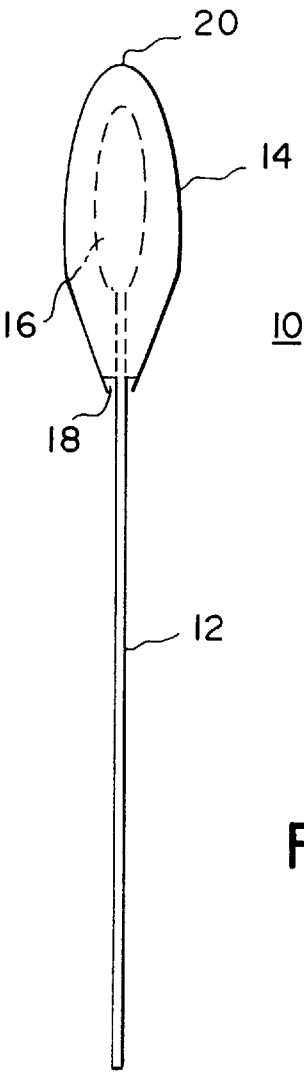
FIG. 2 is a side view of the cleaning device.

As shown in FIGS. 1 and 2, the cleaning element 14 is formed into a generally triangular shape that is attached at its apex 14' to the debris resistant elongated support (also available from Berkshire Corporation, Great Barrington, Mass.) so as to cover the swab 16, and to present an elongated side 20 arranged opposite of the apex 14' as a broad cleaning surface. The elongated side 20 extends between two acute angle end sections 22 of the cleaning element. The end sections 22 present two corner cleaning surfaces. These end sections 22 provide additional capability for cleaning of the optical surface. For example, the end sections 22 also allow the cleaning device 10 to reach areas on the optical surface which may have been otherwise unreachable. As a result, the elongated side 20, with its broad cleaning surface, and the two end sections 22 provide a thorough cleaning of the optical surface.

Figure 3:
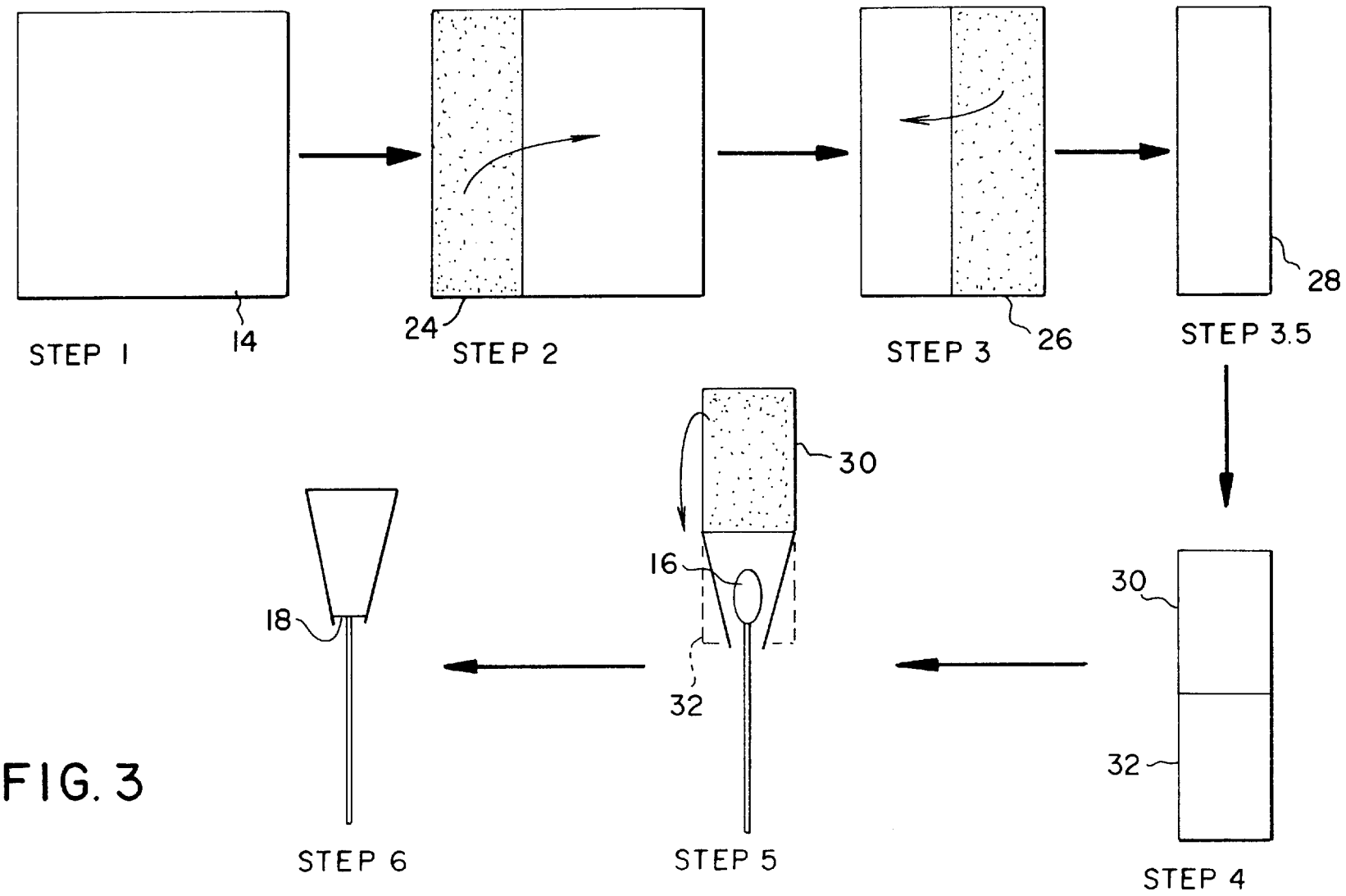
FIG. 3 illustrates the steps of making the cleaning device.

Referring to FIG. 3, the steps for making the cleaning device 10 are graphically shown in accordance with the present invention. Step 1 shows the unfolded cleaning element 14. Step 2 shows the folding of the first portion 24 of the cleaning element 14 towards the center of the cleaning element 14. Step 3 shows the folding of the second portion 26 of the cleaning element 14 opposite of the first portion 24, towards the center, whereby one folded portion overlaps the other folded portion and forms a layered cleaning element 28, as shown in Step 3.5 and 4. Step 5 shows the placing of the elongated support 12, having the absorbent swab 16 secured to one end of the elongated support 12, towards the center of the layered cleaning element 28 so as to form a top portion 30 above the swab 16 and a bottom portion 32 below the swab 16. Step 5 also shows the folding of the top portion 30 of the layered cleaning element 28 over the swab 16 to overlie the bottom portion 32 of the cleaning element 14. Step 6 shows the securing of the folded top and bottom portions 30 and 32 of the cleaning element 14 to the elongated support 12 with a clean rubber band 18.

In the preferred embodiment, the cleaning element 14 is a two inch by two inch square. The first and second portions are each of a size two thirds inch by two inches. The top and bottom portions are each of a size one third inch by one inch.

Referring to FIG. 4, a camera unit 34 is shown with an imager 36 having a cover glass 42 arranged over a charge coupled device (CCD) 44. Camera unit 34 includes a removable lens 46 that attaches to a lens ring 38. The CCD imager 36 is located in the back of the camera unit 34 behind the lens ring 38 in the image plane of the lens 46. An eye cup 40 is shown for a through the lens viewing system. As also shown in FIG. 4, the position of the CCD imager 36 inside the camera unit 34 can make cleaning difficult. According to the present invention, when the lens 46 is removed, the cleaning device 10 is inserted through the lens opening to contact the cover glass 42 (as shown in broken lines in FIG. 4). The present invention provides cleaning of the CCD imager surface 36 by stroking the cleaning device over the cover glass 42 once in both directions, and then using the end sections 22 to reach the edges of the cover glass 42. Preferably, the cleaning device is only used once and disposed after usage. This aids in ensuring that particles removed will not be reapplied to the optical surface.

The invention has been described with reference to a preferred embodiment. However, it will be appreciated that variations and modifications can be effected by a person of ordinary skill in the art without departing from the scope of the invention.

What is claimed is:

1. A device for cleaning an optical surface, comprising:

a debris resistant elongated support;

an absorbent swab attached to an end of the debris resistant elongated support; and a cleaning element secured to said end of the debris resistant elongated support so as to cover the swab and to present an elongated side as a broad cleaning surface, said elongated side extending between two acute angle end sections of the cleaning element which present two comer cleaning surfaces to clean the optical surface.

2. The device of claim 1 wherein the cleaning element is a non-woven, polyester and cellulose blended material.

3. A device for cleaning an optical surface, comprising:

a debris resistant elongated support;

an absorbent swab attached to an end of the debris resistant elongated support;

a generally triangular cleaning element secured at one apex thereof to said end of the debris resistant elongated support so as to cover the absorbent swab, said cleaning element having an elongated side arranged opposite the apex for cleaning the optical surface.

4. The device of claim 3 further having two acutely angled corner cleaning surfaces.

5. The device of claim 3 wherein the cleaning element is non-woven, polyester and cellulose blended material.

6. A clean wipe device for cleaning an optical surface, comprising:

a debris resistant elongated support having a swab attached thereon; and an optical cleaning swipe attached for covering the swab, the optical cleaning swipe being folded to form a triangular shaped cleaning swipe which presents a broad cleaning surface and two comer cleaning surfaces to clean the optical surface.

7. The device of claim 6 further comprising means for adhering the optical cleaning swipe to the debris resistant support.

8. The device of claim 6 wherein the optical cleaning swipe is made from a non-woven, polyester and cellulose blended material.

9. The device of claim 6 wherein the swab is formed from a polyurethane foam.

10. The clean wipe device according to claim 6 wherein the optical surface is a cover glass on a charge coupled device imager surface.

11. A method for making a clean wipe device for cleaning an optical surface, said method comprising the steps of:

folding a first portion of a cleaning swipe toward the center of the cleaning swipe;

folding a second portion of the cleaning swipe opposite of the first portion, toward the center, whereby one folded portion overlaps the other folded portion and forms a layered swipe;

placing a debris resistant elongated support, having an absorbent swab secured to one end, toward the center of the layered swipe so as to form a top portion above the swab and a bottom portion below the swab;

folding the top portion of the layered swipe over the swab to overlie the bottom portion; and securing the folded top and bottom portions to the debris resistant elongated support.

12. The method of claim 11 wherein the optical surface is a cover glass on a charge coupled device (CCD) imager surface.

13. A method for making a clean wipe device for cleaning an optical surface, said method comprising the steps of:

folding a left third of a square cleaning swipe towards a center of the swipe;

folding a right third of a square swipe towards a center of the swipe, whereby one fold overlaps the other and forms a rectangular shaped swipe;

placing a debris resistant elongated support having a cotton swab attached thereon in the center of the resulting rectangular shaped swipe with the cotton swab end of the debris resistant elongated support resting on the swipe;

folding a top half of the swipe over the debris resistant elongated support with the swab portion of the elongated support being covered;

tapering the bottom folds of the swipe to the debris resistant elongated support; and adhering the bottom folds of the swipe to the debris resistant elongated support.

14. The method of claim 13 wherein the optical surface is a cover glass on a charge coupled device (CCD) imager surface.

* * * * *